US011242235B2

(12) United States Patent
Caffa et al.

(10) Patent No.: US 11,242,235 B2
(45) Date of Patent: Feb. 8, 2022

(54) GRIPPING ASSEMBLY FOR CAPPING HEAD FOR THE APPLICATION OF CAPS ON CONTAINERS OR BOTTLES

(71) Applicant: AROL S.P.A., Canelli (IT)

(72) Inventors: Marco Caffa, Cortemilia (IT); Marco Cipriani, Alpignano (IT)

(73) Assignee: AROL S.P.A., Canelli (IT)

( * ) Notice: Subject to any disclaimer, the term of this patent is extended or adjusted under 35 U.S.C. 154(b) by 2 days.

(21) Appl. No.: 16/342,476

(22) PCT Filed: Oct. 18, 2017

(86) PCT No.: PCT/IB2017/056475
§ 371 (c)(1),
(2) Date: Apr. 16, 2019

(87) PCT Pub. No.: WO2018/073762
PCT Pub. Date: Apr. 26, 2018

(65) Prior Publication Data

US 2020/0048060 A1 Feb. 13, 2020

(30) Foreign Application Priority Data

Oct. 21, 2016 (IT) ..... 102016000106114

(51) Int. Cl.
*B67B 3/00* (2006.01)
*B67B 3/20* (2006.01)
*B67B 3/26* (2006.01)

(52) U.S. Cl.
CPC ..... *B67B 3/2066* (2013.01); *B67B 3/268* (2013.01); *B67B 2201/08* (2013.01)

(58) Field of Classification Search
CPC ..... B67B 3/268; B67B 3/2053; B67B 3/2066
See application file for complete search history.

(56) References Cited

U.S. PATENT DOCUMENTS 3,975,886 A * 8/1976 Waters ..... B67B 3/24 53/310
5,157,897 A * 10/1992 McKee ..... B67B 3/2033 53/308

(Continued)

FOREIGN PATENT DOCUMENTS

CN 103481056 A 1/2014
CN 203653201 U 6/2014

(Continued)

*Primary Examiner* — Eyamindae C Jallow
(74) *Attorney, Agent, or Firm* — Howson & Howson LLP

(57) ABSTRACT

A gripping assembly for a capping head for applying caps on containers, as well as a capping head, are provided. The gripping assembly comprises a hollow body longitudinally extending along a vertical axis and internally defining a seat delimited at its lower end by an inlet mouth for the introduction of a cap. An ejector member is housed inside the hollow body such that the ejector member is free to slide axially. The gripping assembly further comprises a suspension member made of magnetic material or magnetizable material, and the ejector member carries a first magnetic element that interacts with the suspension member to determine a suspension condition of the ejector member. The magnetic interaction between the first magnetic element and the suspension member is such that the suspension condition is determined only when the ejector member is brought in close proximity of or, in contact with, the suspension member.

16 Claims, 3 Drawing Sheets

(56) References Cited

U.S. PATENT DOCUMENTS

| | | | | |
|---|---|---|---|---|
| 5,809,742 | A * | 9/1998 | Takakusaki | B65B 55/24 53/317 |
| 7,334,380 | B2 | 2/2008 | Brunee | |
| 9,388,031 | B2 * | 7/2016 | Schoenfelder | B67B 3/2066 |
| 9,388,032 | B2 * | 7/2016 | Singur | B67B 3/268 |
| 2005/0183388 | A1 | 8/2005 | Cirio | |
| 2010/0307110 | A1 * | 12/2010 | Wilhelm | B67B 3/12 53/329.2 |
| 2011/0162331 | A1 * | 7/2011 | Singur | B67B 3/2066 53/485 |
| 2013/0000251 | A1 | 1/2013 | Singur | |

FOREIGN PATENT DOCUMENTS

| | | | | |
|---|---|---|---|---|
| DE | 102010022291 | B3 * | 12/2011 | B67B 3/268 |
| EP | 1424307 | A1 | 6/2004 | |
| EP | 2724976 | A2 * | 4/2014 | B67B 3/2066 |

* cited by examiner

GRIPPING ASSEMBLY FOR CAPPING HEAD FOR THE APPLICATION OF CAPS ON CONTAINERS OR BOTTLES

The present invention concerns a gripping assembly for a capping head for the application of caps on containers or bottles, as well as a capping head using at least one such assembly. More particularly, the present invention concerns a capping head for the application of caps on containers or bottles, equipped with ejection means which are particularly reliable and safe from the point view of hygiene.

Capping heads are devices allowing tightly sealing a cap or plug on the mouth of containers or bottles, for instance of the kind intended for containing foodstuffs such as beverages. Such heads include, in known manner, an assembly for gripping a cap, which is moved by means of a moving assembly located axially above the gripping assembly. In general terms, the moving assembly includes a plurality of control mechanisms and the associated lubricating system enclosed within a casing.

Capping heads are generally employed in capping assemblies also referred to as "capping machines", which usually include a movable support moving a plurality of capping heads, generally mounted on the periphery of the same support, by following a path along which also the containers to be capped are conveyed and synchronously with the same containers.

While each capping head and the corresponding container positioned below the head are moving along the common path, the capping head, previously loaded with a cap kept in position by a gripping assembly, moves downwards, while possibly rotating the gripping assembly in order to screw the cap on the neck of the container, and then moves back to a lifted position.

If the cap application operation is not performed, e.g. because there is no underlying container or because of a misaligned positioning of the cap in the gripping assembly of the head, preventing the proper cap application on the mouth of the container, it is necessary that such a cap is removed before the head returns to the position in which it takes a new cap in order to perform a new capping cycle on a new container.

To this end, the prior art capping heads are generally equipped with an ejection rod, which is mounted so as to be axially slidable through the assemblies forming the head and the axial position of which is controlled by a respective control drive, e.g. a mechanical cam drive, in which a roller connected to the rod is slidably constrained.

The Applicant has noticed that the provision of an ejection rod guided through the capping head may be a source of contamination between the gripping assembly located in the lower part of the head, kept in aseptic condition, and the above-lying moving assembly, through which assemblies the rod slides.

Actually, in order to comply with the cleanliness and hygienic safety rules required e.g. in the foodstuff field, it is necessary to keep the moving assembly isolated from the gripping assembly, since, as said above, the former includes the various control mechanisms of the machine and the associated lubricating system.

In order to obviate the above drawback, it is known to use an ejector member, confined within the lower and outer portion only of the head, in place of the ejection rod passing through the moving assembly and coming out from the bottom thereof towards the gripping assembly. More particularly, a small cylinder is provided, which is housed within the cap receiving seat defined in the gripping assembly so as to be free to axially slide in such a seat and is connected to a circumferential outer flange surrounding the gripping assembly. When the cap is taken, it penetrates into the receiving seat and tends to axially raise the small cylinder jointly with the circumferential flange.

If the cap, when leaving the capping path, remains inside the receiving seat in the gripping assembly, whereby the outer flange is in a raised positon, the cap interacts with stop walls preventing it from being raised together with the capping head. Such an interaction causes a lowering of the flange relative to the cap receiving seat and, consequently, a downward push exerted by the small cylinder on the cap present in the seat, thereby ejecting the cap.

The Applicant has noticed that such a solution, even though it does not entail the risk of contamination between the moving assembly and the gripping assembly since the ejector member is wholly confined within the gripping assembly only, has however some drawbacks. Such a solution is subjected to frequent unwanted cap losses during the capping travel. Actually, when the cap is inserted into the receiving seat in the gripping assembly, the cylinder rests by gravity on the cap itself and may cause accidental ejections.

The Applicant has further considered that, in order to obviate such a drawback, use of inner or outer compensation springs is not suitable, since such a solution makes the product more difficult to sanitise.

Lastly, the Applicant has noticed that the flange of the ejector member provided in the capping heads presently known is subjected to wear because of the interaction contact with the stop walls.

The problem to be solved by the present invention is therefore to provide a gripping assembly for a capping head, which is equipped with a cap ejecting member capable of operating without contamination while being at the same time capable of minimising the risk of unwanted ejections.

Within such a problem, it is an object of the present invention to conceive a gripping assembly for a capping head, which is equipped with a cap ejecting member having a simple overall structure, which can be produced with limited costs and is easy to be sanitised.

In particular, it is another object of the present invention to make a gripping assembly for a capping head equipped with a cap ejecting member that substantially is not subjected to wear.

In accordance with a first aspect thereof, the invention concerns therefore a gripping assembly for a capping head for the application of caps on containers or bottles, comprising a hollow body longitudinally extending along a vertical axis and internally defining a receiving and retaining seat for the cap, the receiving and retaining seat being delimited at its lower end by an inlet mouth for the introduction of the cap, inside the hollow body there being housed an ejector member that is free to axially slide, the gripping assembly being characterised in that it comprises a suspension member made of magnetic material or of a magnetisable material and in that the ejector member carries at least one first magnetic element suitable to magnetically interact with the suspension member in order to determine a suspension condition of the ejector member, the magnetic interaction between the first magnetic element and the suspension member being such that the suspension condition is determined only when the ejector member is brought in close proximity of or in contact with the suspension member.

In the present description and in the appended claims, the expression "magnetisable material" is intended to denote any material that, under the action of an external magnetic field, is capable of becoming polarised and possibly maintaining such a polarisation in time. In general terms, ferromagnetic and paramagnetic materials are magnetisable materials.

In the present description and in the appended claims, the expression "suitable to (magnetically) interact only when in proximity" is intended to denote those magnetic couplings generating a sufficient attraction force to overcome the gravity force only when the interacting elements are put in close proximity or in contact.

The Applicant has realised that the use of a magnetic element placed on the ejector member allows attaining a suspension condition when the ejector member, upon the introduction of the cap into the receiving seat, is pushed upwards and is brought in close proximity of the suspension member of magnetic or magnetisable material.

Actually, the Applicant has realised that, if a sufficient attraction force to overcome the gravity force is developed between the magnetic element placed above the ejector member and the suspension member only under such a condition, it is possible to attain a magnetic suspension condition without however affecting the operation of the ejector member and altering it in the subsequent operation phases.

Advantageously, therefore, the ejector member does not discharge its weight on the cap, thereby substantially eliminating the risk of accidental cap ejections during the capping path, and at the same time the ejecting action performed by the ejector member is not affected by the magnetic interaction.

Such a configuration, providing for confining the ejector member within the gripping assembly, thus within the outer part of the capping head, is capable of preserving the conditions of absence of contamination with the inner part of the capping head.

Moreover, the proposed solution, which uses neither internal nor external springs for supporting the weight of the ejector member, provides a structure that is easy to sanitise.

In accordance with a second aspect thereof, the invention concerns a capping head comprising a gripping assembly suitable to receive and retain a cap inside it, wherein the gripping assembly is connected at its upper side to a moving assembly of the gripping assembly located axially above the gripping assembly, characterised in that the gripping assembly is made as described above.

In accordance with a third aspect thereof, the invention concerns a capping assembly comprising a movable support structure for moving at least one capping head for the application of caps on containers or bottles along a conveying path of containers to be capped, comprising at least one capping head for the application of caps on containers or bottles as described above.

Advantageously, the capping head and the capping assembly according to the invention attain the technical effects described above in connection with the gripping assembly for a capping head for the application of caps on containers or bottles.

The present invention may have at least one of the following preferred features, which can be in particular combined together at will in order to cope with specific application requirements.

Preferably, the at least one first magnetic element is at least one permanent magnet embedded in an outer wall of the ejector member and projects from the same wall.

More preferably, the at least one first permanent magnet is embedded in an upper outer wall of the ejector member and projects upwards from the same wall.

In the alternative, the permanent magnet is embedded in a side outer wall of the ejector member and laterally projects from the same wall.

Preferably, the at last one permanent magnet is ring shaped or includes a plurality of magnets having the same polarity arranged in a ring-shaped configuration Preferably, the suspension member is at least a portion of an inner wall of the hollow body.

More preferably, the suspension member is at least a portion of a wall extending orthogonally to the axis and delimiting the hollow body on the upper side.

Advantageously, in this manner, the orthogonal wall, besides acting as a suspension member for the ejector member, also implements an upper end stop for the axial sliding thereof.

In the alternative, the suspension member is located in proximity of and above an upper wall of the hollow body and in proximity thereof.

Preferably, the ejector member is rigidly connected to a circumferential flange mounted so as to be slidable along the axis outside the hollow body, More preferably, the flange is rigidly connected to the ejector member through a diametrical pin engaging with a pair of longitudinal slots formed in the side wall of the hollow body.

More preferably, at least one second magnetic element projecting from the upper flange surface is embedded in the flange rim.

Even more preferably, the at least one second magnetic element includes an annular magnet or a plurality of magnets having the same axial polarity arranged in a ring-shaped configuration.

Preferably, the at least one second magnetic element cooperates with at least one third magnetic element having the same polarity, which is mounted on at least one wall located along the perimeter of the movable support structure of the capping assembly.

More preferably, the at least one third magnet projects from a lower surface of the at least one wall located along the perimeter of the movable support structure.

Advantageously, when the at least one second magnetic element is in proximity of the at least one third magnetic element, magnetic repulsion prevents the circumferential flange from approaching beyond a given limit distance from and arriving in contact with the pair of horizontal walls. The magnet size is chosen so that the coupling between the second and the third magnetic element is capable of overcoming the attraction force between the first magnetic element and the suspension member.

Thus, a downward movement of the ejector member relative to the hollow body is obtained, which movement determines a downward thrust against the cap and thus the ejection thereof, without any contact between the flange and the wall located along the perimeter of the movable support structure.

This results in considerable benefits in terms of lengthening of the life of the capping head, by reducing wear and creation of micro-powders.

More preferably, the at least one third magnet includes a permanent magnet having an elongated and possibly curved shape, or a plurality of permanent magnets having the same axial polarity arranged along a line or a portion of an arc.

More preferably, the at least one wall located along the perimeter of the support structure is inclined relative to a horizontal plane, and extends from a higher position to a lower position with reference to the direction of forward movement of the support structure.

Advantageously, the inclined arrangement allows generating a progressive force during ejection.

In the alternative, the at least one wall located along the perimeter of the support structure is arranged substantially parallel to a horizontal plane.

Preferably, the at least one first magnetic element is a permanent magnet placed above the ejector member and rigidly connected thereto.

More preferably, the ejector member is rigidly connected to a diametrical pin engaging with a pair of longitudinal slots formed in the side wall of the hollow body.

More preferably, the moving assembly of the gripping assembly internally comprises a rod vertically sliding along the axis and carrying at its lower end a magnetic element having the same axial polarity as the at least one first magnetic element.

The different features in the individual configurations can be combined together at will according the preceding description, should the advantages specifically resulting from a particular combination have to be exploited.

IN THE DRAWINGS

In the following description, for explaining the Figures, the same reference numerals are used to denote constructive elements having the same functions. Moreover, for the sake of clarity of the illustration, it is possible that some reference numerals are not shown in all Figures.

Figure 3:
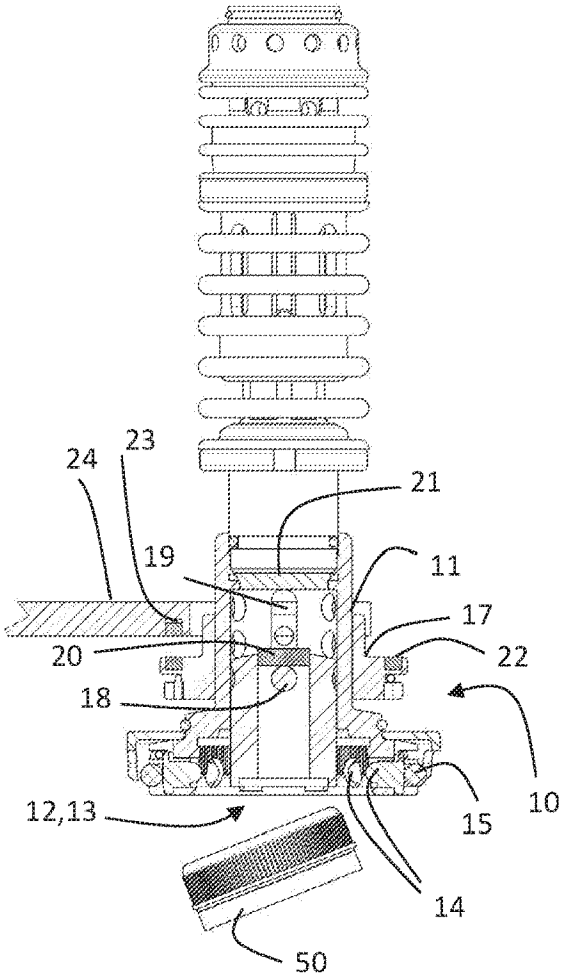
FIG. 3 is a partial second side elevational view, partly in section, of the gripping assembly shown in FIG. 1, at the end of the ejection step.
Figure 2:
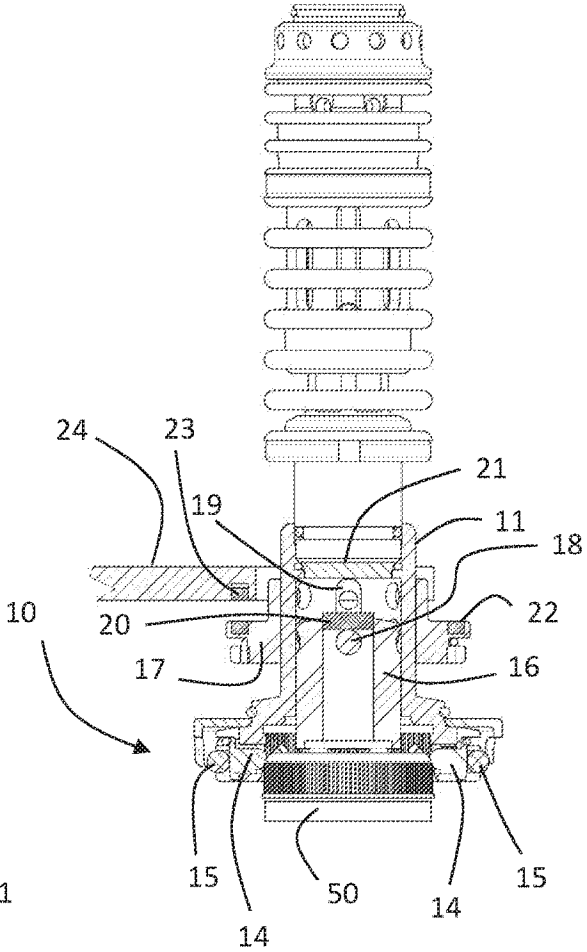
FIG. 2 is a second side elevational view, partly in section, of the gripping assembly shown in FIG. 1, at the beginning of the ejection step.
Figure 1:
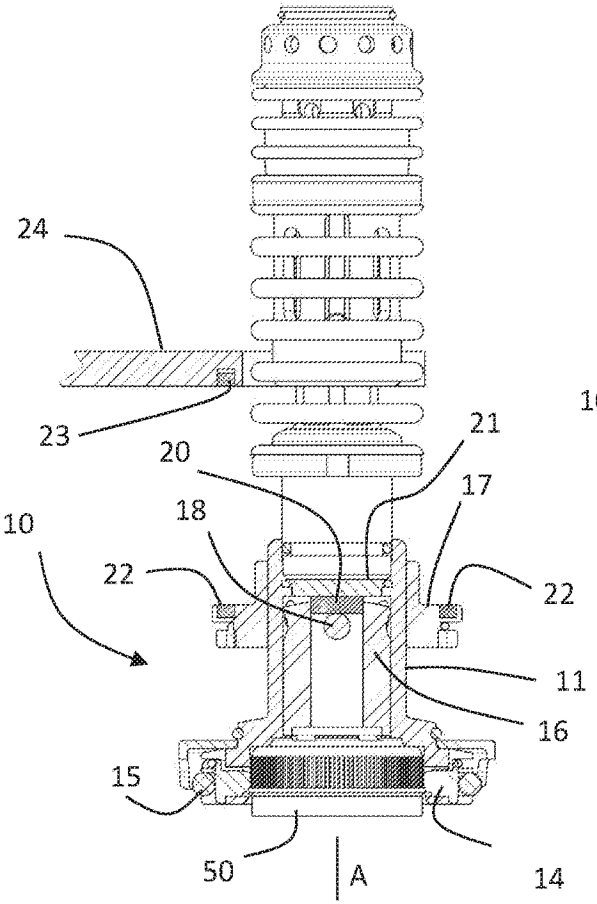
FIG. 1 is a first side elevational view, partly in section, of a first embodiment of a gripping assembly according to the present invention, during the step of cap introduction into the receiving seat of the gripping assembly.
Figure 4:
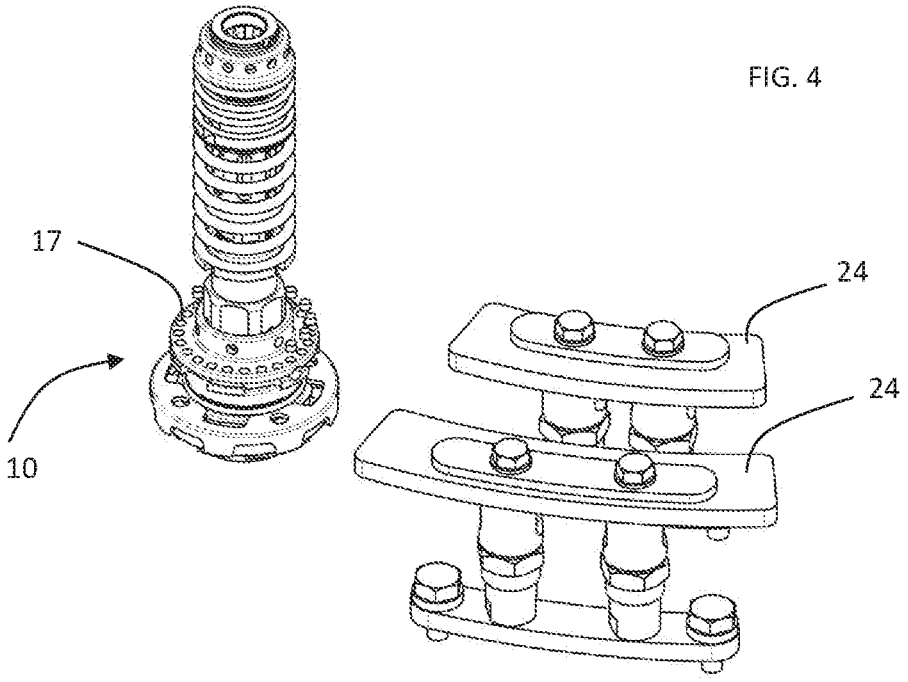
FIG. 4 is a perspective view of the gripping assembly shown in FIG. 1 in a step of approaching the abutment walls with which the gripping assembly cooperates for performing cap ejection.

Referring to FIGS. 1 to 3, there is shown a preferred embodiment of a gripping assembly for a capping head for the application of caps on containers or bottles, denoted in the whole by reference numeral 10.

Gripping assembly 10 is carried at the bottom end of a capping head 30 and is moved by means of a moving assembly 31 located in capping head 30 axially above gripping assembly 10.

Moving assembly 31 is suitable to impart a rotary and/or translatory movement to the gripping assembly and it can be made in any manner known in the art. Similarly, also the structure of the capping assembly on which the capping head is mounted can be made in any manner known in the art.

Figure 5:
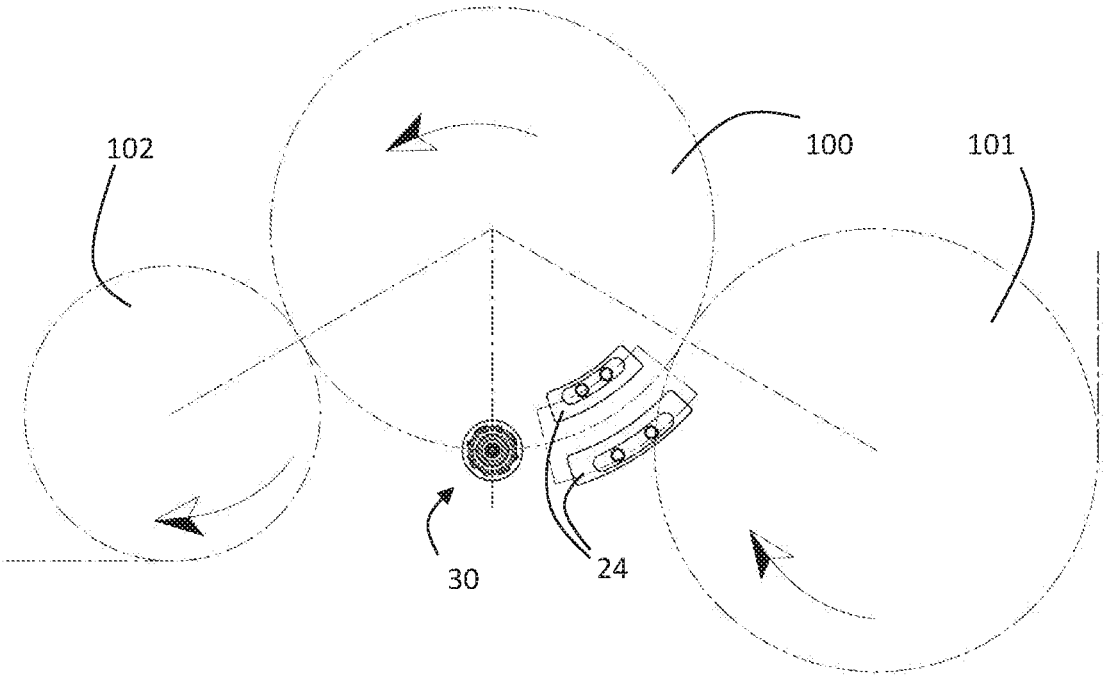
FIG. 5 is a schematic plan view of a capping assembly including a plurality of capping heads equipped with the gripping assembly shown in FIG. 1 and the abutment walls shown in FIG. 4.

In general terms, capping assemblies 100 typically have a carousel structure with a plurality of capping heads circumferentially moving along the carousel synchronously with respective supports for the containers, also mounted on a carrousel 101. Such a capping assembly 100 is schematically shown by way of example in FIG. 5.

At each turn of the carousel, each capping head 30 is axially displaced and is possibly made to rotate to perform the coupling (by insertion or by screwing) of a cap 50 on the mouth of a container (not shown).

During each operation cycle, each capping head 30 takes a respective cap 50 (in known manner) from a cap charger 102, it is lowered in order to apply cap 50 on the container mouth and then it is lifted again to an upper dead-point position where it is again ready to take a new cap 50.

According to a feature known per se, gripping assembly 10 includes a tubular hollow body 11 internally defining a receiving and retaining seat 12 for cap 50. To this end, body 11 has a mouth 13 provided with means suitable to retain cap 50 by positive or non-positive coupling (e.g. resiliently). In the example shown in the Figures, such retaining means include a plurality of balls 14 and a resilient ring 15 surrounding them and extending around tubular body 11. Balls 14 project through openings of the internal surface of seat 12 so that they are pressed against the side wall of cap 50 by resilient ring 15.

When capping head 30 is lowered on cap 50 carried by charger 102 in order to take the cap, cap 50 enters seat 12 by overcoming the action of resilient ring 15, and it is retained in such a seat due to the effect of the elastic reaction of ring 15 pushing balls 14 against the side wall of cap 50, An ejector member 16, which in the embodiment shown in FIGS. 1 to 3 has a cylindrical shape, is slidably mounted inside tubular body 11 of gripping assembly 10. Ejector member 16 is housed or confined within receiving and retaining seat 12 for cap 50 so as to be free to axially translate along axis A of tubular body 11.

Ejector member 16 is rigidly connected to a circumferential flange 17 mounted in an axially slidable manner outside tubular body 11. Flange 17 is rigidly connected to internal ejector member 16 through a diametrical pin 18 engaging with a pair of longitudinal slots 19 formed in the side wall of tubular body 11.

Referring to FIG. 3, when receiving and retaining seat 12 for cap 50 is empty, ejector member 16 is maintained by gravity in its lower end stop position, closer to end mouth 13 of gripping assembly 10.

According to the present invention, ejector member 16 carries at its upper side a first magnetic element 20. Moreover, a wall 21 orthogonal to axis A is provided in tubular body 11, which wall is arranged above ejector member 16 and acts as an upper end stop for the sliding movement of the same ejector member 16. Upper end-stop wall 21 is made of magnetisable material.

In this manner, when a cap 50 is introduced into receiving and retaining seat 12, ejector member 16 moves back to the position shown in FIG. 1.

In such a position, magnetic element 20 is in contact with upper end-stop wall 21, so as to magnetically interact with that wall and to generate a sufficient attraction force to maintain a suspension configuration, whereby ejector member 16 does not discharge its weight on cap 50.

In the preferred embodiment shown in FIGS. 1 to 4, a plurality of second magnetic elements 22 are embedded in the rim of flange 17 and project from the upper surface of flange 17.

The plurality of second magnetic elements 22 cooperate with third magnetic elements 23 having the same axial polarity, which are mounted on a pair of horizontal walls 24 located along the circumferential path of carousel capping assembly 100 immediately upstream, with reference to the movement direction of the carousel, the zone where a new cap 50 is taken at cap charger 102.

The third magnets 23 project from the lower surface of horizontal walls 24. When the second magnetic elements 22 are in proximity of the third magnetic elements 23, magnetic repulsion prevents circumferential flange 17 from approaching beyond a given limit distance from, and hence arriving in contact with, the pair of horizontal walls 24, by overcoming the attraction force between the first magnetic element 20 and stop end wall 21.

Thus, a lifting of capping head 30 relative to the horizontal walls makes ejector member 16 remain at the same height, since flange 17 remains at a distance from said walls 24. This results in a downward movement of ejector member 16 relative to the tubular body carried by capping head 30, which movement determines a downward thrust against cap 50 and thus the ejection thereof.

Figure 6:
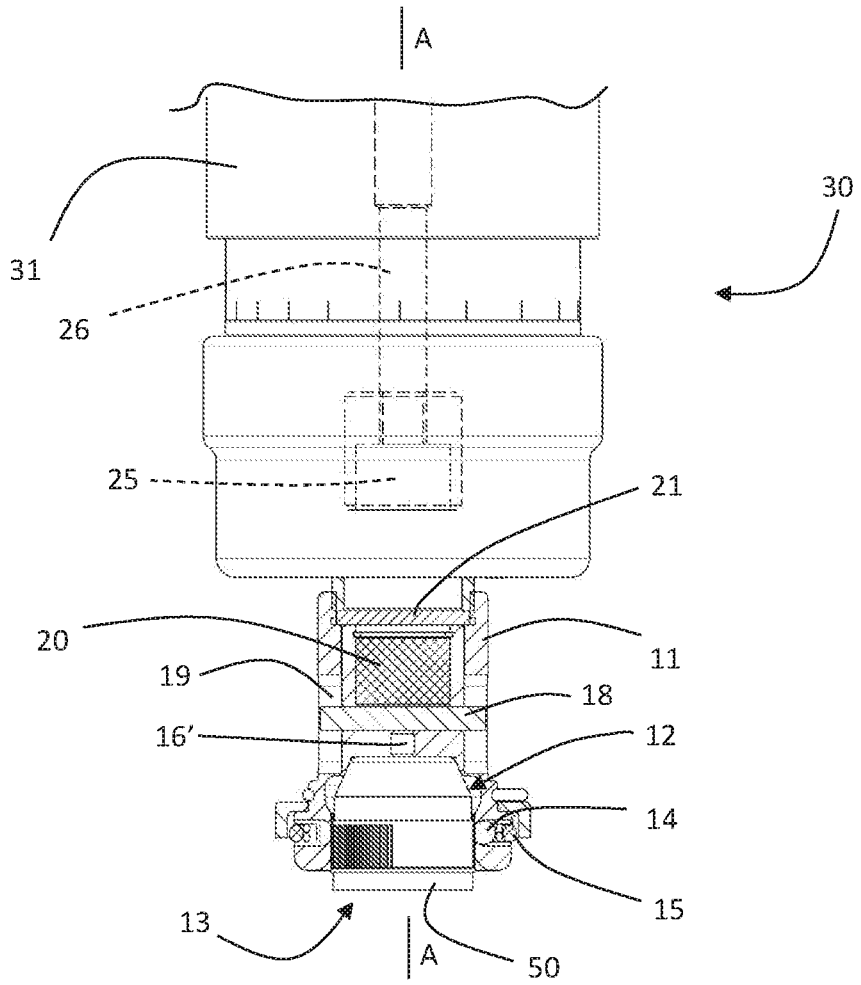
FIG. 6 is a side elevational view, partly in section, of a second embodiment of a gripping assembly according to the present invention, mounted on a capping head.

FIG. 6 shows a capping head 30 including, in its upper portion, a moving assembly 31 for gripping assembly 10, connected at its bottom end to gripping assembly 10 made in accordance with a second embodiment of the present invention.

Also gripping assembly 10 shown in FIG. 6 includes a tubular body 11 in which there is slidably mounted an ejector member 16' housed or confined within receiving and retaining seat 12 for cap 50 so as to be free to axially translate along axis A of tubular body 11.

Ejector member 16' is rigidly connected to a diametrical pin 18 engaging with a pair of longitudinal slots 19 formed in the side wall of tubular body 11 and guiding the axial translatory movement of ejector member 16'.

According to the present invention, a first magnetic element 20 is rigidly connected to the upper side of ejector member 16'. Moreover, a wall 21 orthogonal to axis A and arranged above the first magnetic element 20 is provided in tubular body 11. Such a wall 21 acts as an upper end stop for the sliding movement of the same element 20, besides providing a hermetic separation between the aseptic lower part and the operating upper part of capping head 30. Partition wall 21 is made of magnetisable material.

In this manner, when a cap 50 is introduced into receiving and retaining seat 12, as shown in FIG. 6, ejector member 16' moves back to the position shown. In such a position, the first magnetic element 20 is in contact with partition wall 21, so as to magnetically interact with that wall and to generate an attraction force sufficient to maintain a suspension configuration, whereby ejector member 16 does not discharge its weight on cap 50.

Moreover, a rod 26 vertically slidable along axis A is provided inside moving assembly 31 of gripping assembly 10, which rod carries at its lower end a magnetic element 25 having the same axial polarity as the at least one first magnetic element 20.

When rod 26 is translated so as to approach the first magnetic element 20, magnetic repulsion between the first magnetic element 20 and magnetic element 25 having the same axial polarity causes ejector member 16' to be lowered, thereby determining a downward thrust action against cap 50 and consequently the ejection thereof.

The features of the gripping assembly for a capping head for the application of caps on containers or bottles, as well as of the corresponding capping head and the corresponding capping assembly according to the present invention, are clearly apparent from the above description, as are clearly apparent the relevant advantages.

Further variants of the embodiments described above are possible without departing from the teaching of the invention.

Lastly, it is clear that a gripping assembly for a capping head for the application of caps on containers or bottles as conceived is susceptible of several changes and modifications, all lying within the scope of the invention. Moreover all details can be replaced by technically equivalent elements. In the practice, any material, as well any size, can be employed depending on the technical requirements.

The invention claimed is:

1. A gripping assembly (10) of a cap (50) for a capping head (30) for the application of caps on containers or bottles, comprising a hollow body (11) longitudinally extending along a vertical axis (A) and internally defining a receiving and retaining seat (12) for the cap, the receiving and retaining seat (12) being delimited at its lower end by an inlet mouth (13) for the introduction of the cap (50), inside the hollow body (11) there being housed an ejector member (16, 16') that is free to axially slide, wherein the gripping assembly comprises an end-stop wall (21) made of magnetic material or magnetizable material, wherein the ejector member is slidable between a lower end stop position in which the ejector member is closer to the inlet mouth (13) and is maintained by gravity in the lower end stop position when the receiving and retaining seat (12) is empty, and an upper end stop position in which the ejector member (16,16') is brought in proximity of or in contact with the end stop-wall (21) when a cap is introduced in said receiving and retaining seat (12) thereby causing the ejector member, upon the introduction of the cap into the receiving and retaining seat, to be pushed upwards and brought in close proximity of the end stop wall of magnetic or magnetizable material, and wherein the ejector member (16, 16') carries at least one first magnetic element (20) suitable to magnetically interact with the end-stop wall (21) in order to determine a suspension condition of the ejector member (16, 16'), the magnetic interaction between the first magnetic element (20) and the end-stop wall (21) being such that the suspension condition is determined only when said ejector member (16, 16') is brought in close proximity of or in contact with the end-stop wall (21), whereby a weight of the ejector member is not discharged on the cap (50).

2. The gripping assembly (10) according to claim 1, wherein the at least one first magnetic element (20) is at least one permanent magnet embedded in an outer wall of the ejector member (16) and projecting from that wall.

3. The gripping assembly (10) according to claim 2, wherein the end-stop wall (21) is at least an inner wall portion of the hollow body (11).

4. The gripping assembly (10) according to claim 3, wherein the ejector member (16) is rigidly connected to a circumferential flange (17) mounted in a slidable manner along the axis outside the hollow body (11), at least one second magnetic element (22) being embedded in the flange (17) and projecting from an upper surface of the flange (17).

5. The gripping assembly (10) according to claim 4, wherein the at least one second magnetic element (22) comprises an annular magnet or a plurality of magnets with the same axial polarity placed according to an annular arrangement.

6. The gripping assembly (10) according to claim 2, wherein the ejector member (16) is rigidly connected to a circumferential flange (17) mounted in a slidable manner along the axis outside the hollow body (11), at least one second magnetic element (22) being embedded in the flange (17) and projecting from an upper surface of the flange (17).

7. The gripping assembly (10) according to claim 6, wherein the at least one second magnetic element (22) comprises an annular magnet or a plurality of magnets with the same axial polarity placed according to an annular arrangement.

8. The gripping assembly (10) according to claim 1, wherein the at least one first magnetic element (20) is a permanent magnet placed above the ejector member (16') and rigidly connected thereto.

9. A capping head (30) for the application of caps on containers or bottles, comprising a gripping assembly (10) of a cap (50) according to claim 1 that is connected at its upper side to a moving assembly (31) of the gripping assembly (10).

10. The capping head (30) according to claim 9, wherein the moving assembly (31) internally comprises a rod (26) that is vertically slidable along the axis (A) and that carries, at its lower end, at least one magnetic element (25) having the same axial polarity as the at least one first magnetic element (20).

11. A capping assembly (100) comprising a movable support structure for moving at least one capping head (30) for the application of caps (50) on containers or bottles along a conveying path of containers to be capped, comprising at least one capping head (30) for the application of caps on containers or bottles according to claim 9.

12. The capping assembly (100) according to claim 11, wherein at least one second magnetic element (22) cooperates with at least one third magnetic element (23) having the same axial polarity, mounted on at least one wall (24) located along a perimeter of the movable support structure and projecting from a lower surface of the at least one wall (24) located along the perimeter of the movable support structure.

13. The capping assembly (100) according to claim 12, wherein the at least one wall (24) placed along the perimeter of the support structure has an inclination with respect to the horizontal and extends from a higher position to a lower position with reference to a forward movement direction of the support structure.

14. The gripping assembly (10) according to claim 1, wherein the end-stop wall (21) is at least an inner wall portion of the hollow body (11).

15. The gripping assembly (10) according to claim 1, wherein the ejector member (16) is rigidly connected to a circumferential flange (17) mounted in a slidable manner along the axis outside the hollow body (11), at least one second magnetic element (22) being embedded in the flange (17) and projecting from an upper surface of the flange (17).

16. The gripping assembly (10) according to claim 15, wherein the at least one second magnetic element (22) comprises an annular magnet or a plurality of magnets with the same axial polarity placed according to an annular arrangement.

* * * * *